US005079884A

United States Patent [19]

Menchetti

[11] Patent Number: 5,079,884

[45] Date of Patent: Jan. 14, 1992

[54] EXTENDIBLE INTERCONNECTED Z-STUDS

[75] Inventor: Robert J. Menchetti, Buffalo, N.Y.

[73] Assignee: National Gypsum Company, Dallas, Tex.

[21] Appl. No.: 532,761

[22] Filed: Jun. 4, 1990

[51] Int. Cl.[5] ..... E04H 1/00

[52] U.S. Cl. ..... 52/241; 52/243.1; 52/275; 52/632; 52/634; 52/732; 52/726; 52/579

[58] Field of Search ..... 52/243.1, 579, 632, 52/732, 726, 633, 738, 634, 588

[56] References Cited

U.S. PATENT DOCUMENTS

| | | | |
|---|---|---|---|
| 2,157,233 | 5/1939 | Geib, Jr. | 52/634 |
| 2,356,309 | 8/1944 | Garbe | 52/275 |
| 2,926,928 | 3/1960 | Bennett | 52/588 |
| 3,008,550 | 11/1961 | Miles et al. | 52/241 |
| 3,204,382 | 9/1965 | McGurn | 52/241 |
| 3,492,766 | 2/1970 | Andrews | 52/243.1 |
| 3,897,668 | 8/1975 | McDonnell | 52/632 |
| 4,397,127 | 8/1983 | Mieyal | 52/632 |
| 4,490,958 | 1/1985 | Lowe | 52/634 |

FOREIGN PATENT DOCUMENTS

| | | | |
|---|---|---|---|
| 637132 | 2/1962 | Canada | 52/579 |
| 729341 | 3/1966 | Canada | 52/634 |
| 364229 | 8/1906 | France | 29/897.3 |
| 1590435 | 6/1981 | United Kingdom | 52/732 |

*Primary Examiner*—Richard E. Chilcot, Jr.
*Assistant Examiner*—Joanne C. Downs
*Attorney, Agent, or Firm*—Laird F. Miller; Robert F. Hause

[57] ABSTRACT

An extendible stud, consisting of two substantially identical Z-studs each of which has opposed flanges of substantially different widths and inwardly turned lips at the flange outer edges, and each Z-stud having a central raised ridge in its web, raised in a direction toward the wider flange, which two Z-studs are interconnected by the narrow flange of each being held within the channel formed by the wider flange of the other Z-stud along with its associated lip and web. Also the method of interconnecting two Z-studs and the method of erecting hollow partitions with the extendible stud.

14 Claims, 2 Drawing Sheets

EXTENDIBLE INTERCONNECTED Z-STUDS

This invention relates to interconnectable Z-shaped sheet metal studs and more particularly to an interconnected pair of Z-studs, each of which has a raised ridge projecting outwardly from the center of the stud web, whereby the ribs of the two Z-studs press against each other, providing a slidable but tight friction fit of the interconnected studs with very loose fitting interconnected flanges.

BACKGROUND OF THE INVENTION

Formed sheet metal studs are commonly used in erecting drywall partitions, most commonly having a C-shaped cross-section. Extendible C-shaped studs have been used wherein one C-stud is slid into another slightly larger C-stud, larger by an amount equal to the metal thickness, requiring unacceptably close tolerances.

Another form of sheet metal stud that has been proposed for drywall construction is a Z-shaped stud, wherein the two opposed flanges of the stud extend in opposite directions from the stud web.

U.S. Pat. Nos. 3,606,418 and 4,461,134 each disclose a modification of a Z-stud in which the two flanges each have an inwardly turned outer lip and one flange is slightly larger than the other, again by an undesirably exact amount equal to the metal thickness, whereby, according to the teachings, in each patent, a pair of like studs can be interconnected by rotating one of the studs of the like pair through 180° on a longitudinal axis, and placing the smaller flanges of each in the channels formed by the larger flanges and their adjacent webs and lips.

SUMMARY OF THE INVENTION

The present invention consists of a Z-stud in which the two flanges differ in width by considerably more than just the thickness of the metal. Each flange has an inwardly angled lip along the outer edge, preferably at an angle of about 850° to the flange.

The central web of the Z-stud has an elongate central raised ridge, raised in the direction of the wider flange. The height of the raised ridge is slightly greater than half the difference between the widths of the two flanges.

Two similar Z-studs of this novel structure can easily be combined into an extendible stud by rotating one stud 180° about its longitudinal axis and placing the narrow flange in each stud into the channel formed by the wider flange and adjacent web and lip of the other Z-stud. The raised ridges of the two Z-studs will then abut one another, holding the flanges in place, while permitting the two studs to be moved longitudinally relative to each other, providing an easily extendible and retractable stud.

It is an object of the present invention to provide a novel extendible sheet metal stud.

It is a further object to provide an extendible stud which requires only two parts, which two parts are of identical structure.

It is a still further object to provide a two-part extendible stud which is very easily assembled, does not require close tolerances, and permits easy extension and retraction while capable of firmly retaining any length at which it is set.

BRIEF DESCRIPTION OF THE DRAWINGS

These and other objects and advantages of the invention will be more readily apparent when considered in relation to the preferred embodiments as set forth in the specification and shown in the drawings in which.

DESCRIPTION OF THE PREFERRED EMBODIMENTS

Figure 1:
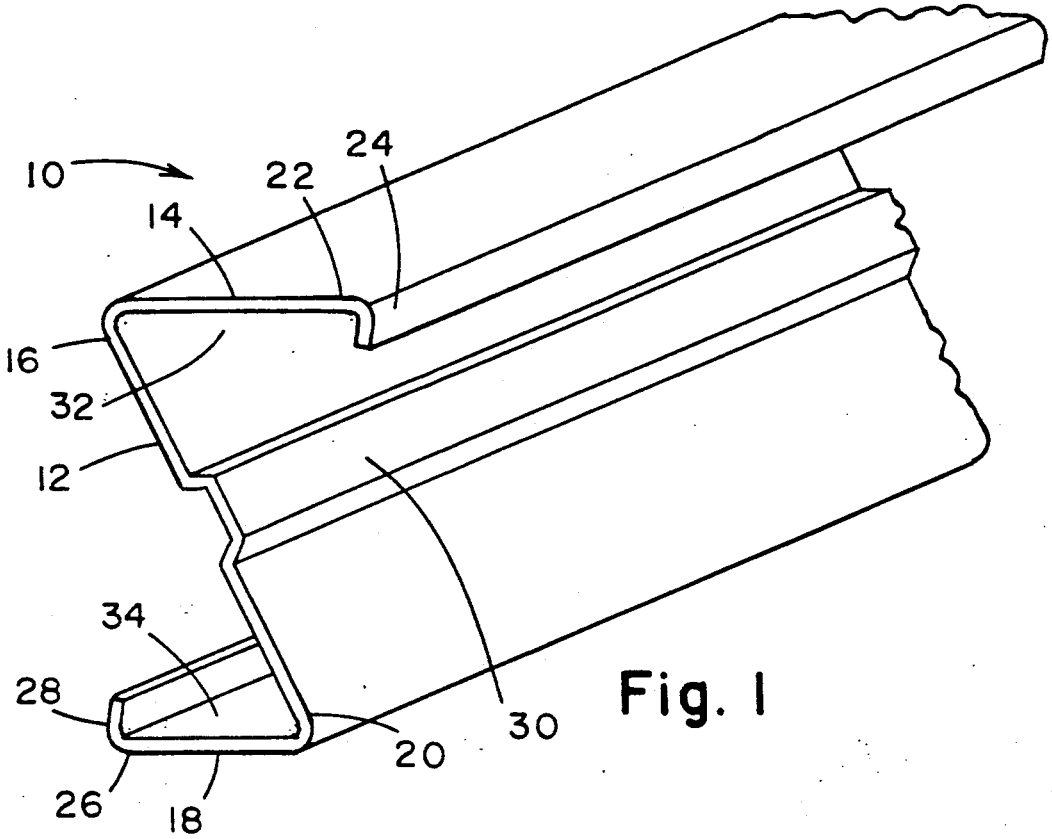
FIG. 1 is an isometric view of a Z-stud formed in accordance with the present invention.

Referring to FIG. 1, there is shown an elongate, sheet metal, galvanized steel Z-stud 10, formed with a generally Z-shaped cross-section, including an elongate central web 12, an elongate relatively wide upper flange 14 shown extending to the right from the upper edge 16 of web 12 and an elongate relatively narrow lower flange 18 shown extending to the left from the lower edge 20 of web 12, parallel to flange 14. At the right, outer edge 22 of the upper flange 14 is a downwardly directed elongate lip 24, and at the left, outer edge 26 of the lower flange 18 is an upwardly directed elongate lip 28.

The web 12 joins the two flanges 14 and 18 and has an elongate central raised ridge 30. Web 12 forms an angle "a" with each flange 14 and 18, in the preferred form being about 60°. Lips 24 and 28 form an angle "b" with each respective flange 14 and 18, in the preferred form being about 85°. These angles can be varied widely from these preferred amounts, so long as the total of angles "a" and "b" equals less than 180°. Accordingly, both flanges 14 and 18, in combination with lips 24 and 28 and web 12, form a relatively narrow-mouthed wide channel 32 and a narrow-mouthed narrow channel 34.

In one preferred form of the invention, the web 12 is 2½ inches wide, ridge 30 is ½ inch wide and about ⅛ inch high, upper channel 32 is 1½ inches wide, lower flange 18 is 1¼ inches wide, lips 24 and 28 are ¼ inch wide and the metal is 0.020 inch thick.

Figure 2:
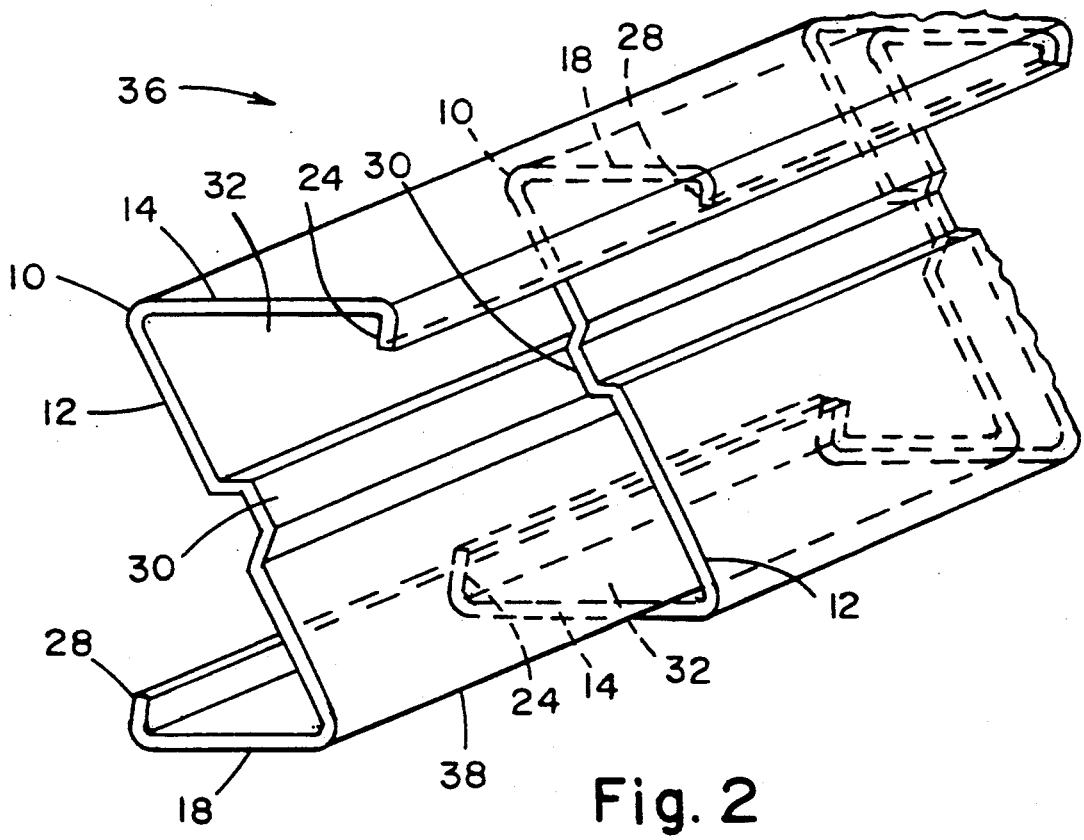
FIG. 2 is an isometric view of an extendible stud formed by interconnecting two studs similar to the stud of FIG. 1.
Figure 3:
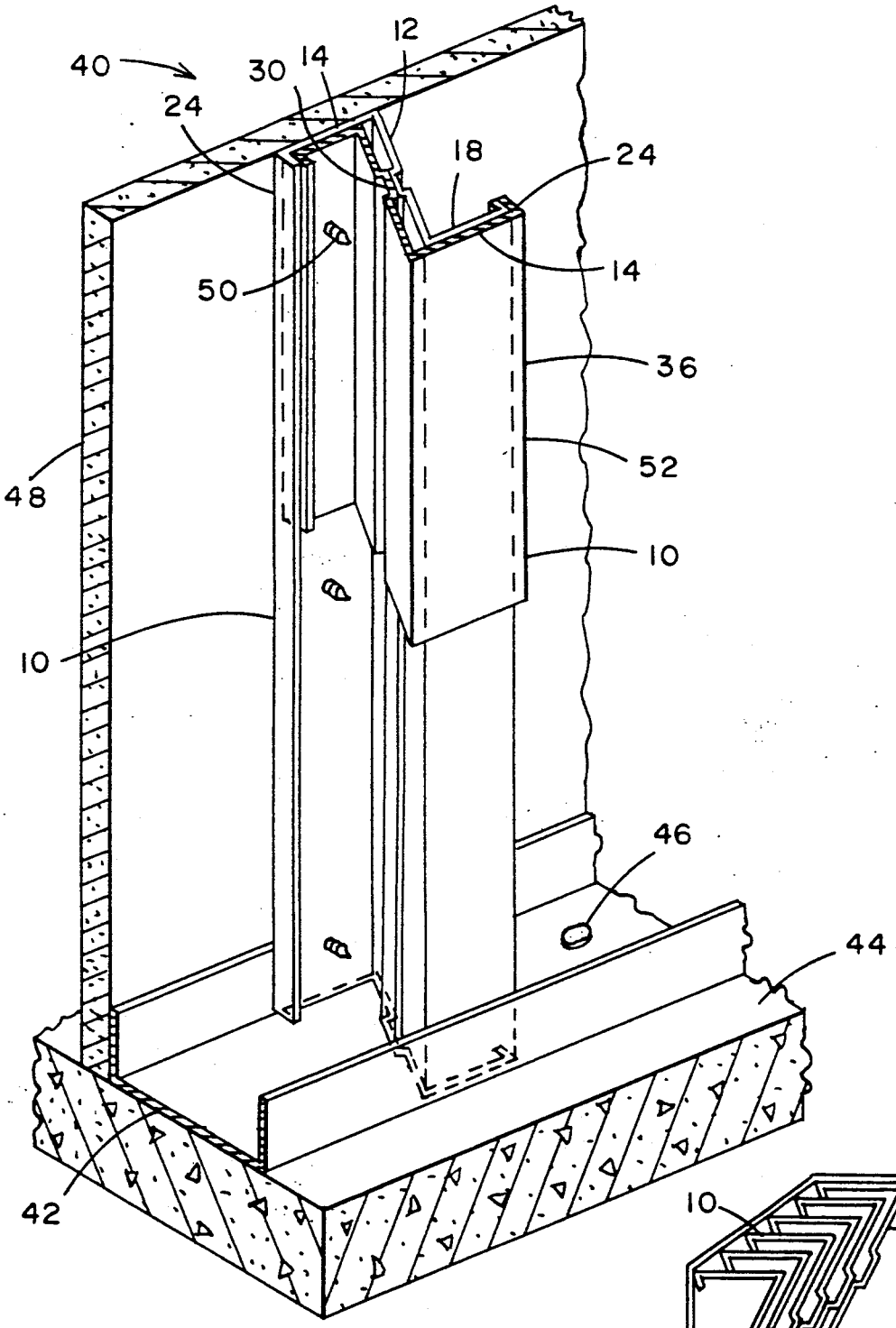
FIG. 3 is an isometric view of a partially constructed hollow partition including the extendible stud of FIG. 2 disposed in a floor track, and wallboards screw-attached to the extendible stud and to the floor track.

Referring to FIG. 2, an extendible stud 36, which consists of two Z-studs 10, which have been interconnected by rotating one of the two sutds 180° about its longitudinal axis, and then inserting the narrow flange 18 of each stud 10 into the relatively wide channel 32 of the other stud. The two Z-studs 10 are preferably of the same length and are definitely interconnected with at least one of the two Z-studs 10 having an end portion 38 extending outwardly from the other of the two Z-studs 10, for grasping and extending the extendible stud 36. The narrow flanges 18 of each of the two Z-studs 10 are substantially narrower than the wide flanges 14, however, with the raised ridge 30, of each of the two Z-studs 10, being raised in a direction toward the ridge 30 of the opposite Z-stud 10, the narrow flanges 18 are urged, by the ridges 30, outwardly, fitting tightly against the lips 24 of the wide flange 14. Because the channels are relatively narrow-mouthed, as mentioned above, after the narrow flange 18 of one Z-stud 10 has been inserted in a wider channel 32 of the other Z-stud 10, the other narrow flange 18 of the other Z-stud 10 must be snapped into the wider channel 32 of the first Z-stud 10, whereby each narrow flange 18 and its respective lip 28 are urged outwardly against a lip 24 of the opposite Z-stud 10 by the abutting raised ridges 30.

Because the narrow flanges 18 are not smaller than the wide flanges by an amount equal only to the thickness of the metal, as in the prior art, but instead are much narrower, and are still held firmly in place in the extendible stud 36, the two Z-studs 10 have greater dimensional tolerances and are much more easily moved within one another to extend or shorten the extendible stud 36, as compared to the prior art, and are still held together tight enough so that the two Z-studs 10 do not move relative to one another without some manual effort being exerted.

As a result, a hollow, gypsum wallboard, drywall partition 40 is easily constructed by, first, affixing a floor track 42 to a floor 44 as by rivets 46, placing one end of an extendible stud 36 in the floor track 42, extending the length of the extendible stud 36 until the top of the extendible stud (not shown) fits into a standard ceiling track (not shown), or other suitable means for holding the extendible stud 36 in a vertical position, as will be clearly understood. The extended extendible stud 36, once inserted into floor and ceiling tracks, will remain in place without any further assistance, long enough to attach gypsum wallboards 48 to the extendible studs 36 and the floor and ceiling tracks by self-tapping drywall screws 50. Ceiling heights can typically vary from 6 feet to 10 feet using the same extendible stud 36.

Once the wallboards are screw-attached to the extendible studs 36, the screws 50, some of which could be placed to pierce the overlapping portion 52 of the extendible stud 36, will lock the two Z-studs 10 of the extendible stud 36 into a fixed, desired length of the extendible stud 36.

The novel Z-studs 10 are also suitable for extendible ceiling joists or grids or floor runners of considerable length by interconnecting three or more Z-studs 10 and suspending or placing them in a horizontal disposition, extended to the length or width of a room.

Figure 4:
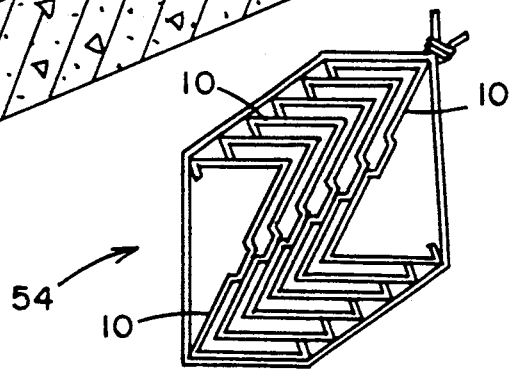
FIG. 4 is an end view of a bundle of Z-studs, nested compactly for storage and shipment.

FIG. 4 shows how the novel Z-studs 10 are also able to be combined into a package 54, for storage and shipment, in a nestled, compact form, but never in an accidental and unintentional interconnected form.

Having completed a detailed description of the preferred embodiments of my invention so that those skilled in the art may practice the same, I contemplate that variations may be made without departing from the essence of the invention.

I claim:

1. A sheet metal Z-stud, adapted for interconnecting with a like Z-stud to form an extendible stud, said Z-stud comprising an elongate central web, an elongate relatively wide flange extending at an angle from one elongate edge of said web, an elongate relatively narrow flange extending at an equal angle from an opposite elongate edge of said web and extending in an opposite direction from said web, an elongate narrow lip extending inwardly at an angle from an outer edge on at least the wider of said flange, said lip forming a narrow-mouthed channel with said respective flanges and said web, and an elongate central raised ridge extending outwardly from said web, toward said relatively wide flange.

2. A sheet metal Z-stud as defined in claim 1 wherein said relatively wide flange is wider than said relatively narrow flange by a distance equal to about twice the height of said raised ridge.

3. A sheet metal Z-stud as defined in claim 1 wherein said narrow-mouthed channel is formed as a result of the total of the two angles at each edge of said flange being less than 180°.

4. A sheet metal Z-stud as defined in claim 1 wherein said web forms an angle of about 60° with each said flange.

5. A sheet metal Z-stud as defined in claim 1 wherein said flanges each have narrow lips which make an angle of about 85° with said flanges.

6. A sheet metal Z-stud as defined in claim 1 wherein said central raised ridge is about ½ inch wide and about ⅛ inch high.

7. A sheet metal Z-stud as defined in claim 1 wherein said Z-stud is formed of galvanized steel of about 0.02 inch thickness.

8. An extendible stud consisting essentially of two Z-studs, each said Z-stud having the structure of claim 1, said Z-studs being interconnected with said narrow flange of each said Z-stud being disposed in said narrow-mouthed channel formed by said wide flange of the other of said two Z-studs.

9. An extendible stud as defined in claim 8 wherein said raised ridge on each said Z-stud protrudes from said Z-stud web towards said other Z-stud raised ridge and said raised ribs are disposed abutting one another.

10. An extendible stud as defined in claim 8 wherein said two Z-studs are of equal length.

11. An extendible Z-stud as defined in claim 8 wherein said relatively wide flanges are wider than said relatively narrow flanges by a distance equal to about the sum of the heights of said raised ridges of said two Z-studs.

12. A hollow partition comprising a floor track, a plurality of extendible studs as defined in claim 8, and a plurality of wallboards affixed to said flanges of said extendible studs, said extendible studs having one of said two Z-studs extending vertically downward and engaging said floor track and another of said two Z-studs extending vertically upward and engaging means for holding said extendible stud in a vertical position.

13. A hollow partition as defined in claim 12 wherein said web of each of said Z-studs in each of said extendible studs forms an angle of substantially less than 90° with said Z-stud flanges.

14. A hollow partition as defined in claim 12 wherein said wallboards are affixed to said flanges by screws and wherein at least one of said screws, at each extendible stud, is screwed through an overlapping portion of the two Z-studs of said extendible stud.

* * * * *